US007980559B2

(12) United States Patent
Miller et al.

(10) Patent No.: US 7,980,559 B2
(45) Date of Patent: Jul. 19, 2011

(54) INSTANT-WIN LOTTERY GAME SYSTEM BASED ON A VARYING PATTERN OF LINE SEGMENTS

(75) Inventors: Dennis James Miller, San Antonio, TX (US); Susan Allen, Salem, OR (US)

(73) Assignee: Obethur Gaming Technologies, Inc., Montreal, Quebec (CA)

( * ) Notice: Subject to any disclaimer, the term of this patent is extended or adjusted under 35 U.S.C. 154(b) by 0 days.

(21) Appl. No.: 10/264,498

(22) Filed: Oct. 4, 2002

(65) Prior Publication Data

US 2003/0178767 A1 Sep. 25, 2003

(51) Int. Cl.
*A63B 71/00* (2006.01)
*A63F 3/06* (2006.01)

(52) U.S. Cl. ..... 273/139; 273/269

(58) Field of Classification Search ..... 273/139
See application file for complete search history.

(56) References Cited

U.S. PATENT DOCUMENTS 3,589,291 A * 6/1971 Koszul ..... 101/490
5,112,058 A * 5/1992 Sandeen ..... 273/269
5,118,109 A * 6/1992 Gumina ..... 273/139
5,193,815 A * 3/1993 Pollard ..... 273/269
5,286,061 A * 2/1994 Behm ..... 283/95
5,303,929 A * 4/1994 Sandeen ..... 273/269
5,411,260 A * 5/1995 Smith ..... 273/139
5,499,816 A * 3/1996 Levy ..... 273/139
5,624,119 A * 4/1997 Leake ..... 273/269
5,657,991 A * 8/1997 Camarato ..... 273/269
5,803,504 A * 9/1998 Deshiens et al. ..... 283/67
5,927,541 A * 7/1999 Stoken et al. ..... 221/2
5,931,467 A * 8/1999 Kamille ..... 273/139
5,957,458 A * 9/1999 Haas et al. ..... 273/269
6,000,725 A * 12/1999 Nicolosi et al. ..... 283/67
6,047,964 A * 4/2000 Lawandy et al. ..... 273/138.1
6,076,860 A * 6/2000 Holman et al. ..... 283/109
6,241,246 B1 * 6/2001 Guttin et al. ..... 273/139
6,398,643 B1 * 6/2002 Knowles et al. ..... 463/17
6,491,297 B1 * 12/2002 Cardoso ..... 273/138.1
6,533,274 B1 * 3/2003 Heggerty ..... 273/139
6,557,851 B2 * 5/2003 Gauthier et al. ..... 273/139
6,565,084 B1 * 5/2003 Katz et al. ..... 273/138.1
6,676,126 B1 * 1/2004 Walker et al. ..... 273/139
7,347,776 B2 * 3/2008 Wright ..... 463/17
2001/0002079 A1 * 5/2001 Scrymgeour et al. ..... 273/138.1
2001/0040343 A1 11/2001 Falciglia, Sr.
2002/0003335 A1 * 1/2002 Schaefer et al. ..... 273/139
2002/0047259 A1 * 4/2002 Lambert et al. ..... 283/49
2002/0084584 A1 * 7/2002 Yusuf ..... 273/138.1
2002/0093188 A1 * 7/2002 Downes et al. ..... 283/49
2002/0093190 A1 * 7/2002 Katz ..... 283/100
2002/0109294 A1 * 8/2002 Gauthier et al. ..... 273/139
2003/0045340 A1 * 3/2003 Roberts ..... 463/17
2003/0067109 A1 * 4/2003 Such ..... 273/138.1
2003/0080548 A1 * 5/2003 Borowski et al. ..... 283/49
2003/0162580 A1 * 8/2003 Cousineau et al. ..... 463/17
2005/0140092 A1 * 6/2005 Solano ..... 273/269
2010/0167805 A1 * 7/2010 Martineck, Sr. ..... 463/17

* cited by examiner

*Primary Examiner* — Alvin A Hunter
*Assistant Examiner* — Dolores Collins
(74) *Attorney, Agent, or Firm* — Dority & Manning, P.A.

(57) ABSTRACT

A lottery ticket having a play area containing rows and columns defining individual play spaces with up to all of the play spaces containing a play symbol and at least one line connecting a plurality of play spaces wherein a prize may be won if the line connects at least two preselected play symbols.

13 Claims, 3 Drawing Sheets

INSTANT-WIN LOTTERY GAME SYSTEM BASED ON A VARYING PATTERN OF LINE SEGMENTS

FIELD OF THE INVENTION

A lottery ticket having a play area in which there are provided a plurality of rows and columns with each row and column having a plurality of spaces with up to all of the play spaces containing a play symbol. There is provided at least one line connecting a plurality of the play spaces such that a prize may be won if a line connects at least two preselected play symbols.

BACKGROUND OF THE INVENTION

Scratch-off lottery tickets are common in the lottery industry. Game data in the form of play symbols is covered by a scratch-off layer and when the scratch-off layer is removed, the game data is exposed. Once the scratch-off layer is removed, if the play symbols provide a certain pattern the player may win a prize. Thus, the typical scratch-off lottery tickets require the player to remove the scratch-off layer and immediately determine if and what type of prize has been won.

It is desirable in the scratch-off lottery industry to provide lottery tickets which not only provide the opportunity to win a prize, but also provide the opportunity to have a variety of ways of winning a prize which adds to the entertainment value of the lottery ticket itself.

It would therefore be an advance in the lottery ticket industry to provide a lottery game in which a feature is added to the game providing additional opportunities to win a prize.

SUMMARY OF THE INVENTION

The present invention is generally directed to a lottery ticket in which there is provided a play area having rows and columns containing play spaces with each of the play spaces containing a play symbol. The determination of whether a prize is won is controlled by the appearance of lines connecting individual play spaces which may be in a single row or column or in multiple rows and/or columns. If one or more of the lines connects a preselected number and type of play symbols, then the player may qualify for a prize according to the rules of the lottery game.

In accordance with one aspect of the present invention, there is provided a lottery ticket comprising:

a) a substrate having at least one play area thereon;

b) at least one of the play areas comprising a plurality of row and columns with each row and column having a plurality of play spaces with up to all of the play spaces containing a play symbol;

c) at least one line connecting a plurality of the play spaces; and d) a scratch-off layer covering the play area, wherein a prize may be won if a line connects at least two preselected play symbols.

BRIEF DESCRIPTION OF THE DRAWINGS

The following drawings in which like reference characters indicate like parts are illustrative of embodiments of the invention and are not intended to limit the invention as described in the application herein.

DETAILED DESCRIPTION OF THE INVENTION

Figure 1:
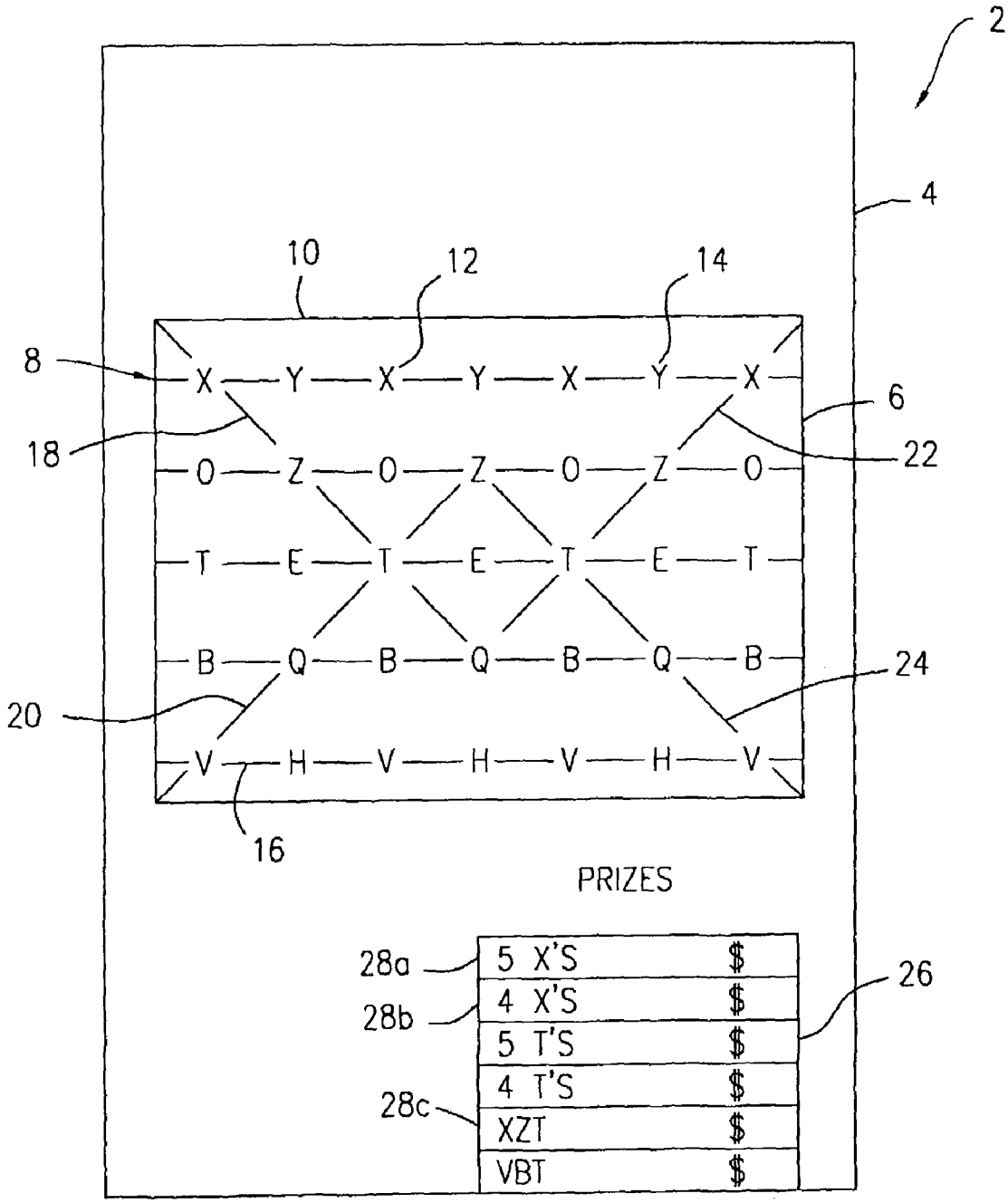
FIG. 1 is a schematic view of one embodiment of the present invention.

Referring to FIG. 1 there is shown a lottery ticket as an embodiment of the present invention. The lottery ticket 2 has a top face 4 which includes at least one play area 6 (one play area 6 is shown in FIG. 1) comprised of a plurality of rows 8 and columns 10 which together define a plurality of individual play spaces 12 with up to all of the play spaces 12 containing a play symbol 14 which may be selected from such symbols as numbers, letters, objects, images, combinations thereof and the like. By way of example and for illustrative purposes only, the present invention will be described employing letters as the play symbols as more fully described hereinafter. It will be understood that the play symbols may be selected to be consistent with the theme of the lottery ticket. For example, if the theme of the lottery ticket is the "sea", suitable play symbols may be seashells, fish, boats and the like.

In accordance with the present invention, there is provided a plurality of lines, each of which connect a plurality of the play symbols. The pattern of lines and play symbols may vary from lottery ticket to lottery ticket and are free from being affected by player influence. Most typically, the pattern of lines will not vary but the pattern of symbols between lottery ticket of the same game will vary.

As specifically shown in FIG. 1, each of the rows 8 has all of the play symbols 14 therein connected by a line. Each of the lines connecting the play symbols 14 of a row 8 is represented by the numeral 16. In accordance with the embodiment of FIG. 1, there are four additional lines each of which traverses a plurality of rows and columns. One such line is designated by the numeral 18 connecting play symbols in the top four rows 8 and the first four columns 10. The line 18 connects the specific play symbols X, Z, T and Q. Additional lines 20, 22 and 24 traverse a plurality of rows and columns and connect a different series of play symbols.

A prize may be won if at least one of the lines connects at least two play symbols of a preselected designation. In this regard, the lottery ticket may be provided with a prize determining section 26 which contains one or more prize designations 28. A prize may be awarded, for example, if one or more of the lines 16, 18, 20, 22 or 24 connects play symbols having a particular play symbol pattern shown in the prize determining area 26.

By way of example, the first prize designation 28*a* listed in the prize designation area 26 requires that a single line connect five "X's". Since there is no single line that connects five X's, no prize is won in this prize category. On the other hand, the second prize designation 28*b* (four X's) is satisfied by the line connecting the play symbols 14 in the topmost row 8. Because the player has satisfied this prize category, the player is entitled to the prize indicated next to the prize designation for four X's.

By way of an additional example, a prize may be awarded if a single line connects the letters "X, Z and T" as shown by prize designation 28*c*. This prize designation (28*c*) is satisfied because line 18 connects the letters required and therefore a prize may be won for this prize designation.

The play area 6 of the lottery ticket shown in FIG. 1 has been shown and described after removal of the scratch-off layer covering the play area 6. It will be understood that the play area shown in FIG. 1 is covered by a scratch-off layer which may or may not have printing graphics printed thereover. The printed graphics may include any design such as a design associated with the theme of the game (e.g. the "sea"). The printed graphics may include a replica of the lines appearing below the scratch-off layer which are used to connect the play symbols. Alternatively, the printed graphics may include a replica of some or all of the play symbols which appear below the scratch-off layer.

Figure 2:
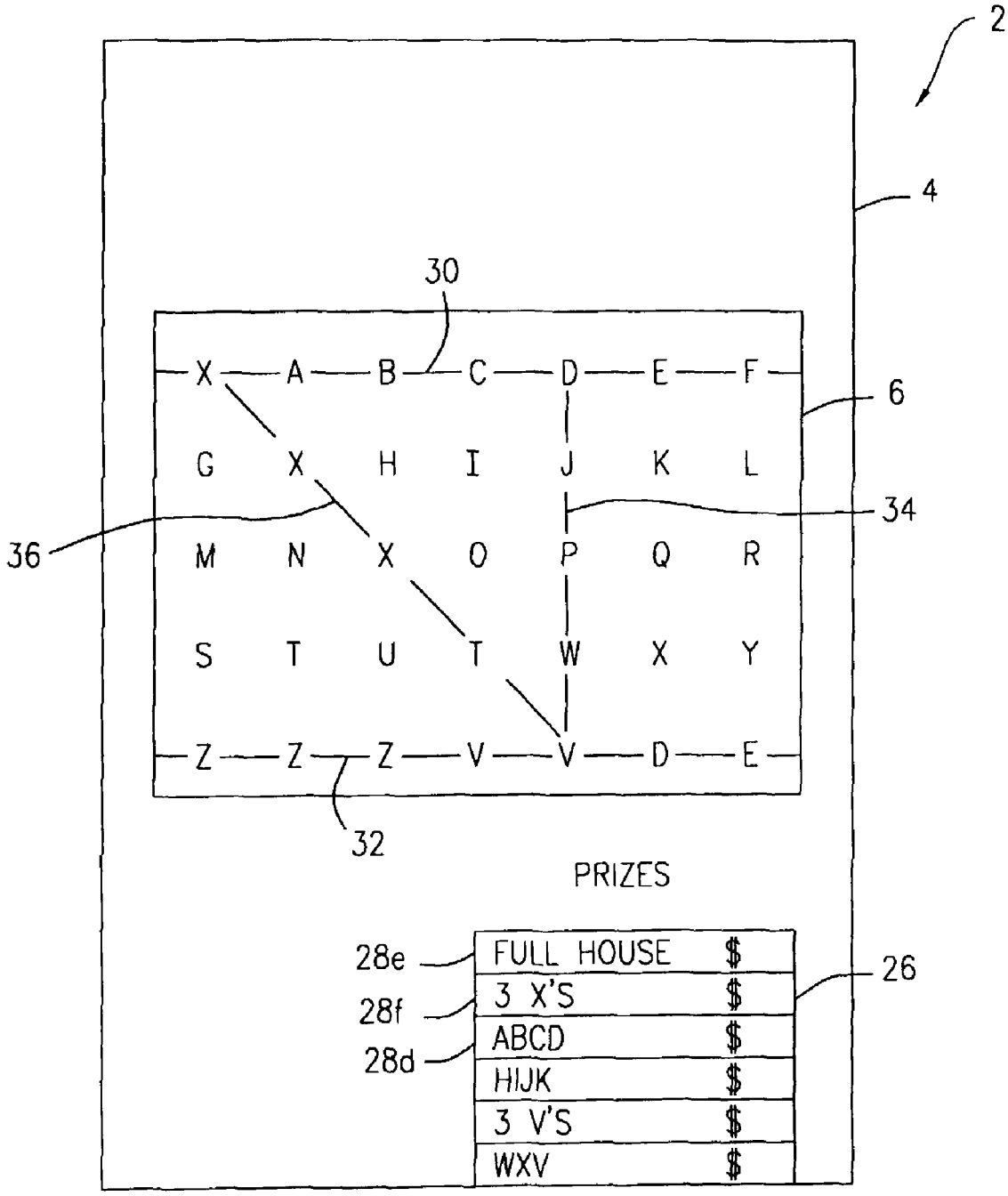
FIG. 2 is a schematic view of a second embodiment of the present invention.

A second embodiment of the present invention is shown in FIG. 2 in which the play area 6 has only four separate lines, two lines connecting play symbols in the topmost and bottommost rows, respectively, one line connecting the play symbols in the fifth column and one line traversing multiple columns and rows as described hereinafter. In this embodiment of the invention, which is a preferred embodiment, prizes are only awarded if the play symbols necessary to win a prize appear consecutively within a single line.

The first line represented by numeral 30 includes the consecutive letters A, B, C and D and therefore meets the third prize designation 28*d* set forth in the prize designation area 26. The bottommost horizontal line represented by the numeral 32 satisfies the prize designation 28*e* ("full house") because the line 32 connects the consecutive play symbols Z, Z, Z, V and V. The vertical line represented by the numeral 34 does not satisfy any of the prize designations. However, the last remaining line 36 traversing multiple columns and rows covers the prize designation 28*f* (3X's) and therefore the player may win a prize for this prize designation. It can therefore be seen that the play symbol can be so designated so as to play a variety of games including card games (e.g. poker) and the like.

Figure 3:
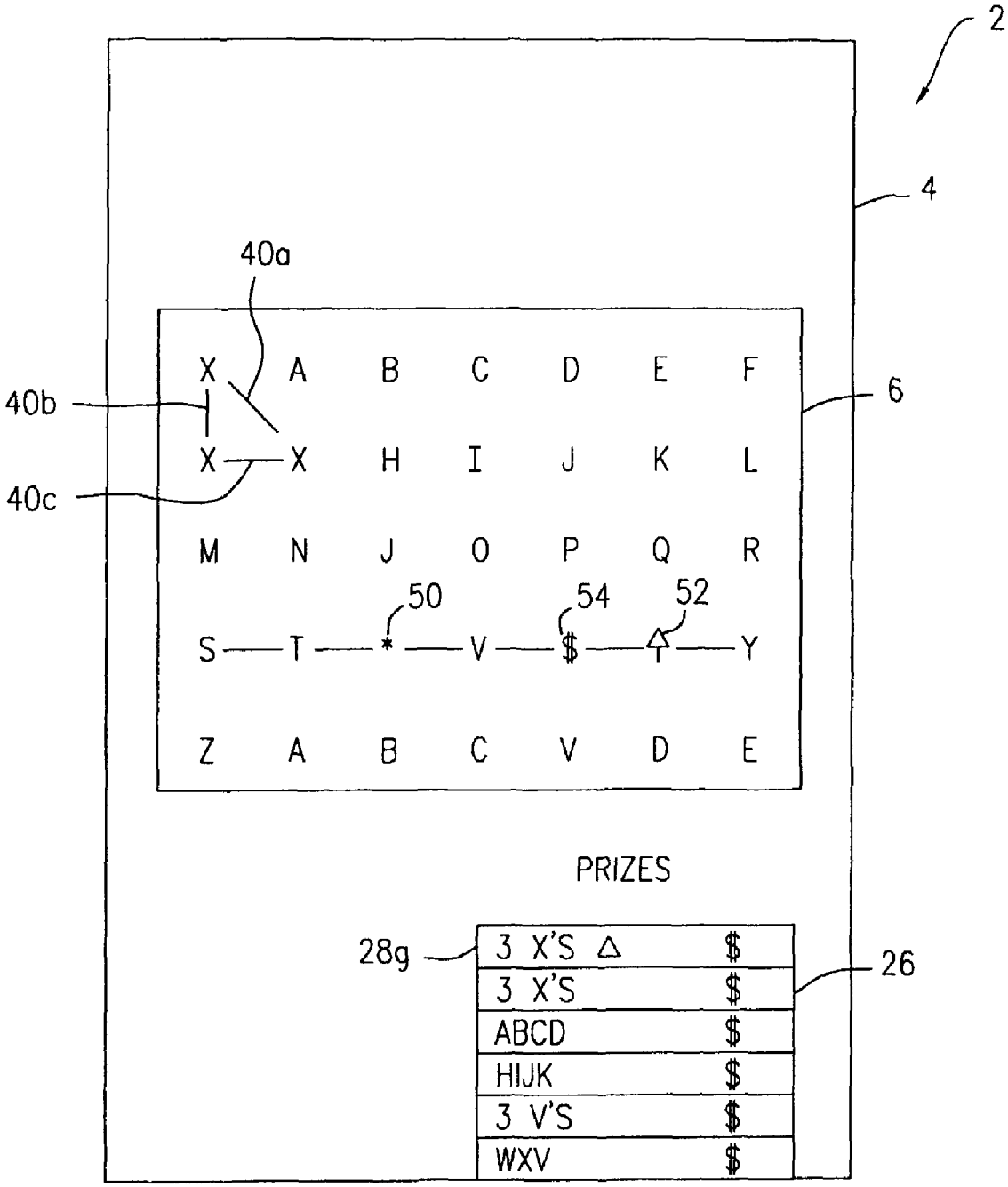
FIG. 3 is a schematic view of a third embodiment of the invention.

In a still further embodiment of the invention as shown in FIG. 3, a prize may be awarded if preselected play symbols appear in a combination of lines such as lines forming a preselected pattern such as a polygon (e.g. a triangle, a hexagon, etc.), an ornamental pattern (e.g. a Christmas tree) or the like. Other patterns may be chosen within the spirit and scope of the invention. Referring specifically to FIG. 3, there are shown three lines 40*a*, 40*b* and 40*c* which together form a triangle. In accordance with the rules of the game, a prize is won because the lines 40*a*-40*c* forming the triangle connect 3X's which wins the prize designated as "3X's Δ" (i.e. 3X's in the form of a triangle) in the prize designation area as indicated by reference numeral 28*g*.

It will therefore be seen that prizes may be won by matching prize designations 28 in the prize designation area 26 which may contain all or typically less than all of the play symbols which are connected by a single line. There are therefore numerous ways of winning prizes in a lottery game that is more exciting to play than typical scratch-off lottery games.

In accordance with a further aspect of the present invention, one or more of the play symbols may be in the form of a game enhancing symbol such as a universal play symbol 50 (e.g. a star "*," as shown in FIG. 3) (which can be adopted by the player to represent any other play symbol), a prize awarding play symbol 52 (e.g. a tree the presence of which automatically results in a prize being won) or a prize enhancing play symbol 54 (e.g. a dollar sign "$") which can be used to increase the value of a prize already won. In one embodiment of the invention the game enhancing symbols, to be valid, must be connected to one or more play symbols by at least one line.

What is claimed is:

1. An instant win lottery game system, comprising:

a plurality of instant win lottery tickets, each of said tickets comprising a play area with a plurality of play spaces arranged in defined pattern for a single play of a game; play symbols depicted in said play spaces;

a plurality of predetermined line segments depicted in said play area, with each said line segment connecting at least two said play spaces, said line segments comprising distinct visible lines having a random placement and orientation in said play area extending vertically, horizontally, or diagonally on the play area such that a varying pattern of said line segments is generated for different said lottery tickets;

a prize award section on said lottery tickets that defines possible prize awards for the game as a function of a defined number or pattern of said play symbols in said play spaces that are satisfied by play symbols connected by said varying pattern of randomly placed and oriented predetermined distinct visible lines comprising the line segments such that the only said play symbols that are considered for the prize award are said play symbols in said play area that are connected by said varying pattern of randomly placed and oriented predetermined distinct visible lines comprising the line segments wherein the varying pattern is free from being affected by player influence; and a scratch-off layer provided over at least a portion of said play area that covers said pattern of predetermined distinct visible lines comprising the line segments such that an unknown variable to the player prior to removal of said scratch-off layer is said varying pattern of line segments.

2. The game system as in claim 1, wherein placement of said play symbols in said play spaces varies between different said lottery tickets.

3. The game system as in claim 1, wherein replica play symbols are printed on said scratch-off layer that correspond to underlying play symbols such that the only unknown variable to the player prior to removal of said scratch-off layer is said varying pattern of line segments.

4. The game system as in claim 1, wherein said scratch-off layer also covers said play symbols such that the unknown variables to the player prior to removal of said scratch-off layer is said varying pattern of line segments and location of said play symbols.

5. The game system as in claim 1, wherein said lines segments have the same length.

6. The game system as in claim 1, wherein at least two of said line segments have a different length.

7. The game system as in claim 1, wherein at least two of said line segments are connected end-to-end to form a connected pattern of said line segments.

8. The game system as in claim 1, wherein said line segments are unconnected to each other.

9. The game system as in claim 1, wherein said play spaces are arranged in a grid of rows and columns.

10. The game system as in claim 9, wherein at least one of said line segments connects fewer said play spaces than the number of said play spaces in said rows and columns.

11. The game system as in claim 9, wherein at least one of said line segments extends through a plurality of said columns and said rows.

12. The game system as in claim 1, wherein said line segments are arranged in a connected pattern.

13. The game system as in claim 1, wherein at least one of said play symbols is selected from a universal play symbol, a prize awarding play symbol, or a prize enhancing play symbol.

* * * * *